US006039031A

United States Patent [19]

Ricco

[11] Patent Number: 6,039,031

[45] Date of Patent: Mar. 21, 2000

[54] DEVICE FOR FASTENING AND SEALING A METERING VALVE IN AN INTERNAL COMBUSTION ENGINE FUEL INJECTOR

[75] Inventor: Mario Ricco, Bari, Italy

[73] Assignee: Elasis Sistema Ricerca Fiat Nel Mezzogiorno Societa Consortile per Azioni, Pomigliano D'Arco, Italy

[21] Appl. No.: 09/190,742

[22] Filed: Nov. 12, 1998

[30] Foreign Application Priority Data

Nov. 18, 1997 [IT] Italy ..... TO97A1008

[51] Int. Cl.[7] ..... F02M 37/04

[52] U.S. Cl. ..... 123/470; 239/600

[58] Field of Search ..... 123/468, 469, 123/470, 472; 239/585.2, 600

[56] References Cited

U.S. PATENT DOCUMENTS 4,860,710 8/1989 Hafner et al. ..... 123/470

5,909,725 6/1999 Balsdon et al. ..... 123/470

FOREIGN PATENT DOCUMENTS 0304747 3/1989 European Pat. Off. .

0548916 6/1993 European Pat. Off. .

*Primary Examiner*—Thomas N. Moulis

*Attorney, Agent, or Firm*—Ladas & Parry

[57] ABSTRACT

The injector has a hollow body supporting a nozzle, and a metering valve having a valve body housed in a cylindrical seat of the hollow body; the valve body has an annular cavity for distributing high-pressure fuel to a control chamber of the valve; the seat communicates with an axial cavity of the hollow body, in which the control rod slides and which is at atmospheric pressure; the valve body is fitted to the hollow body by means of a ring nut; the valve body has a portion having an outer truncated-cone-shaped surface; the seat has a portion having an inner truncated-cone-shaped surface; and the two truncated-cone-shaped surfaces have the same taper, and engage mutually in fluidtight manner by virtue of the ring nut.

6 Claims, 2 Drawing Sheets

DEVICE FOR FASTENING AND SEALING A METERING VALVE IN AN INTERNAL COMBUSTION ENGINE FUEL INJECTOR

BACKGROUND OF THE INVENTION

The present invention relates to a device for fastening and sealing a metering valve in an internal combustion engine fuel injector.

Known injectors normally comprise a hollow body supporting the nozzle; and an axial cavity at atmospheric pressure, in which slides a rod controlling the nozzle. The rod is controlled hydraulically by a metering valve comprising a valve body having a control chamber supplied with pressurized fuel and which discharges into a discharge chamber. The valve body is normally substantially cylindrical, and has a flange which is engaged by a ring nut for fastening the valve body to the hollow body.

In known injectors, the valve body has an annular cavity for distributing fuel to the control chamber and which is therefore also at high pressure, so that the valve body must be connected to the hollow body by means of a sealing device between the pressurized annular cavity on one side and the axial cavity and discharge chamber at atmospheric pressure on the other.

For this purpose, the valve body flange normally rests on a shoulder of the hollow body; and at least one annular seal is provided between the cylindrical wall of the valve body and the hollow body seat, and normally rests on a shoulder of the seat. To ensure effective sealing, the seal is so sized as to fit tightly onto the surface of the valve body, which, for technical reasons, has a radial clearance of 5 to 35 microns with respect to the seat.

During operation of the injector, the high fuel pressure—about 1350 bar—in the distribution cavity tends to push, i.e. extrude, the seal inside the gap between the valve body and its seat, thus resulting in the formation of extrusion rings and in wear of the seal. The pressurized fuel, in turn, leaks increasingly through the extrusion rings, thus reducing the difference in pressure and producing friction-induced heat, which further impairs the resistance of the seal, which begins to fray and must therefore be replaced frequently.

SUMMARY OF THE INVENTION

It is an object of the present invention to provide a device for fastening and sealing a metering valve in an injector of the above type, and which is extremely easy to assembly, is of long working life, and provides for eliminating the aforementioned drawbacks typically associated with known devices.

According to the present invention, there is provided a device for fastening and sealing a metering valve in an internal combustion engine fuel injector, wherein the injector comprises a hollow body supporting a nozzle, and the metering valve has a valve body housed in a seat of said hollow body; said valve body having a flat surface engaged by a ring nut in said hollow body; characterized in that said valve body comprises a portion having an outer truncated-cone-shaped surface; said seat comprising a portion having an inner truncated-cone-shaped surface; said truncated-cone-shaped surfaces having the same taper, and engaging mutually in fluidtight manner by virtue of said ring nut.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
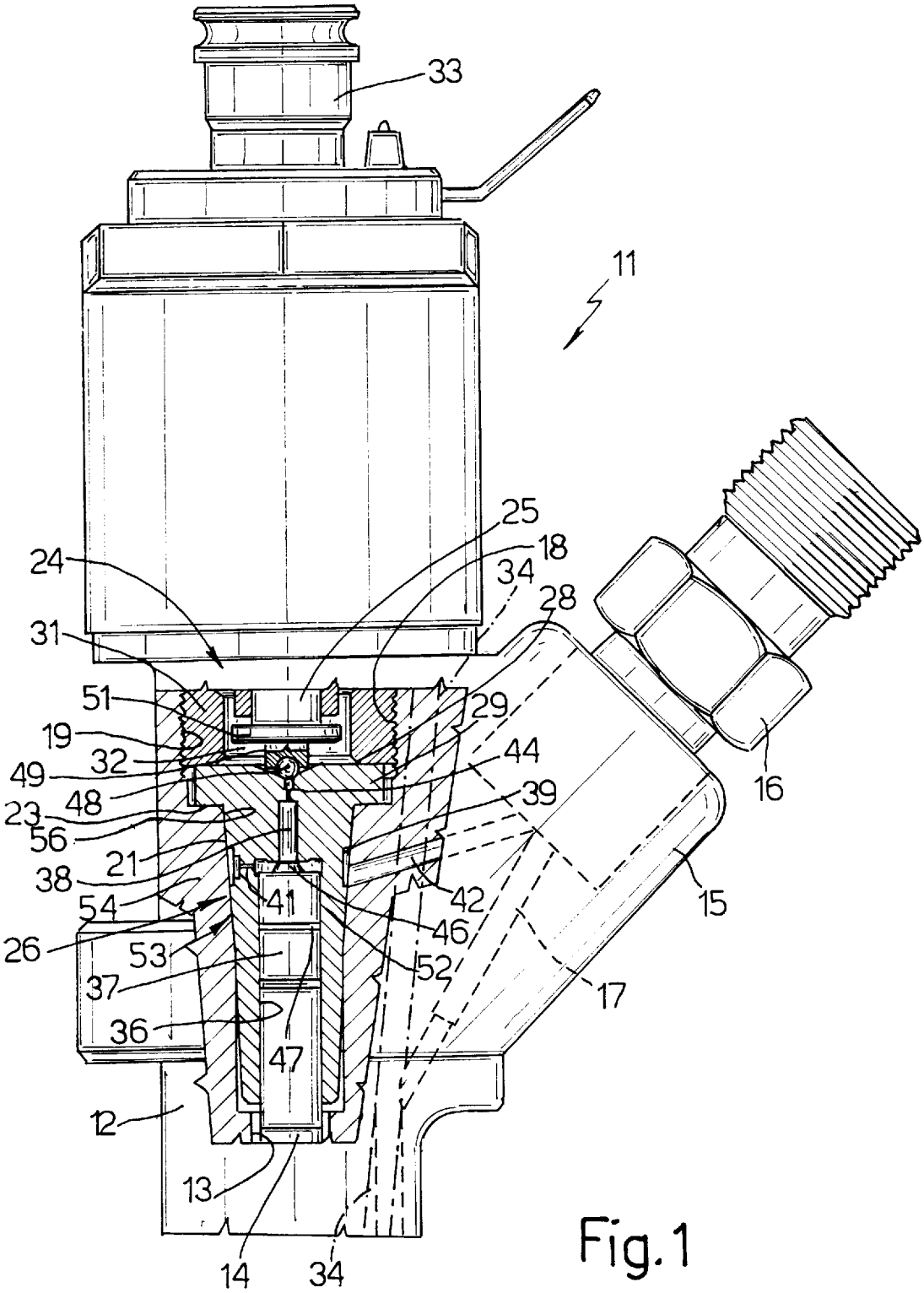
FIG. 1 shows a partial section of a fuel injector featuring a sealing device in accordance with the invention.

Number 11 in FIG. 1 indicates as a whole a fuel injector, e.g. for an internal combustion engine. Injector 11 comprises a hollow body 12 supporting a nozzle (not shown) terminating at the bottom with one or more injection orifices; and body 12 comprises an axial cavity 13 in which slides loosely a control rod 14 connected to a pin closing the injection orifice.

Body 12 also comprises an appendix 15 in which is inserted an inlet fitting 16 connected to a normal fuel supply pump for supplying fuel at very high pressure, e.g. 1350 bar; appendix 15 comprises a conduit 17 connecting fitting 16 to an injection chamber of the nozzle; and body 12 also comprises a substantially cylindrical cavity 18 with a thread 19, and a seat 21 separated from cavity 18 by a shoulder 23.

Injector 11 also comprises a metering valve, indicated as a whole by 24, which is housed inside seat 21, is controlled by the armature stem 25 of an electromagnet (not shown), and in turn comprises a valve body 26 having a flange 29, which has a flat upper surface 28 and is engaged by an externally threaded ring nut 31 screwed to thread 19 of cavity 18.

The gap between ring nut 31 and stem 25 forms a discharge chamber 32 of valve 24, which chamber 32 communicates in known manner with a discharge fitting 33 connected to the fuel tank, so that the fuel in chamber 32 is substantially at atmospheric pressure. Axial cavity 13 of hollow body 12 also communicates with discharge fitting 33, via a discharge conduit 34 formed in body 12, so that cavity 13 is also at atmospheric pressure.

Valve body 26 comprises an axial hole 36 defining a guide seat for a top portion 37 of rod 14; an axial control chamber 38 communicating with hole 36; and an annular groove 39 communicating with an end portion of hole 36 via a calibrated conduit 41, which forms the inlet conduit of control chamber 38. Hollow body 12 comprises another conduit 42 connecting fitting 16 to annular groove 39, which acts as an accumulating and distributing cavity for accumulating and distributing fuel from conduit 42 to control chamber 38, and which therefore normally contains pressurized fuel.

Control chamber 38 comprises a calibrated discharge conduit 44 communicating with discharge chamber 32; the end of top portion 37 of rod 14 has an appendix 46 for cutting off communication between hole 36 and chamber 38 without closing inlet conduit 41; and, to prevent fuel flowing from control chamber 38 to axial cavity 13, portion 37 of rod 14 is provided with two annular seals 47.

Figure 2:
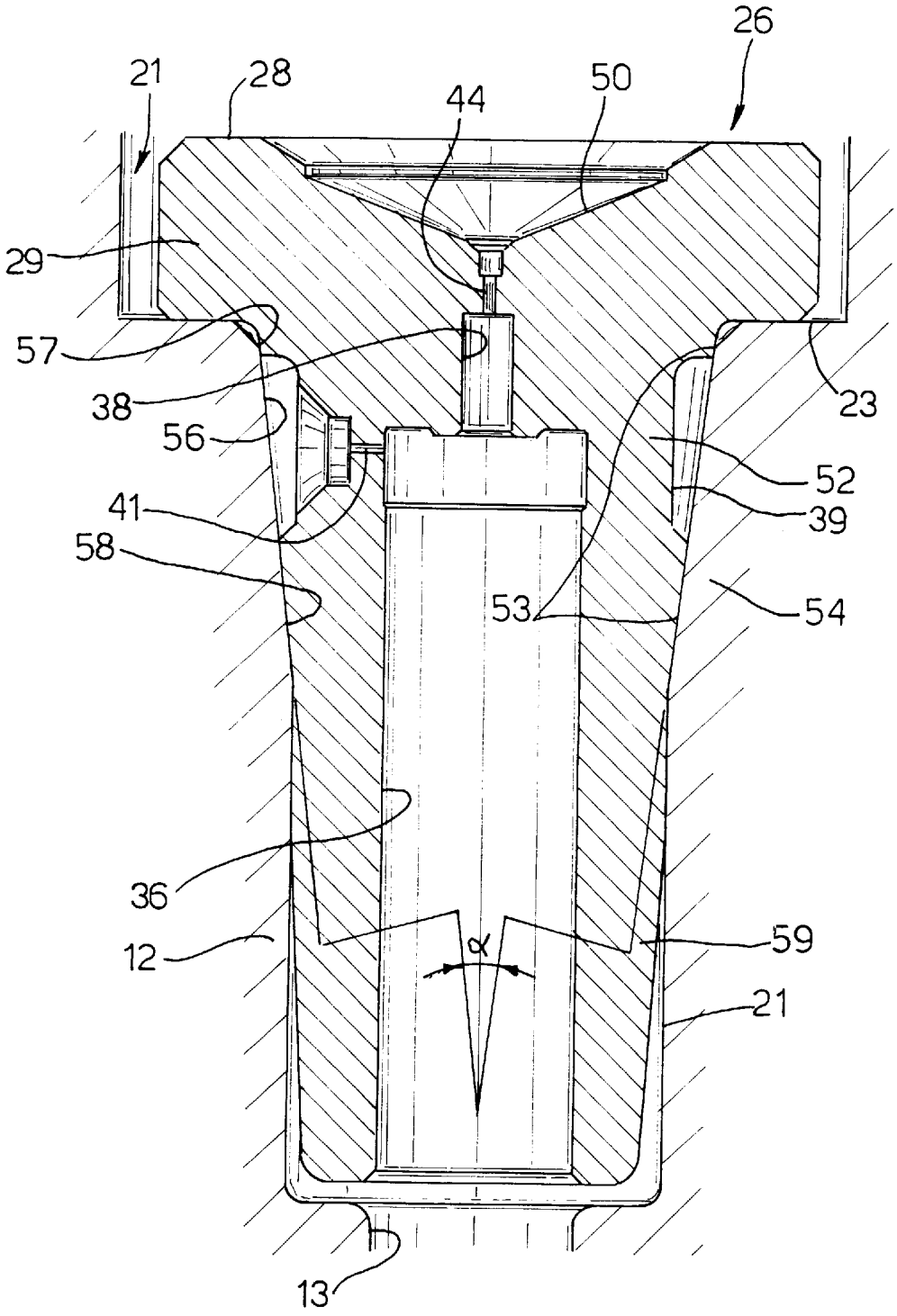
FIG. 2 shows a larger-scale portion of FIG. 1.

The fuel pressure in chamber 38 and the top end of hole 36 normally holds rod 14 down closing the nozzle of injector 11; and discharge conduit 44 of control chamber 38 is normally closed by a shutter in the form of a ball 48, which rests in a conical seat 50 (FIG. 2) defined by a surface adjacent to conduit 44, and is guided (FIG. 1) by a guide plate 49 acted on by a flange 51 of armature stem 25.

As accumulating and distributing cavity 39 normally contains high-pressure fuel, while cavity 13 and discharge chamber 32 contain fuel at atmospheric pressure, the cavity 39 region must be isolated hydraulically from both cavity 13 and chamber 32 by an effective sealing device.

According to the invention, to seal metering valve 24 inside injector 11, i.e. to seal between cavity 39 at high pressure on one side and cavity 13 and discharge chamber 32 at atmospheric pressure on the other, valve body 26 comprises a portion 52 (FIG. 2) having an outer truncated-cone-shaped surface 53, while seat 21 comprises a portion 54 having an inner truncated-cone-shaped surface 56. Truncated-cone-shaped surfaces 53 and 56 have the same taper, and engage mutually, i.e. are brought into contact with each other, in fluidtight manner by ring nut 31 (FIG. 1). Tightening ring nut 31 to thread 19 of cavity 18 obviously does not bring flange 29 into contact with shoulder 23.

More specifically, portion 52 is located at cavity 39, so as to define an upper portion 57 (FIG. 2) above cavity 39 for sealing between cavity 39 and discharge chamber 32, and a portion 58 below cavity 39 for sealing between cavity 39 and axial cavity 13. Portion 52 with truncated-cone-shaped surface 53 is also located between flange 29 and a substantially cylindrical portion 59, coaxial with portion 52, of valve body 26.

Valve body 26 is made of fairly hard, accurately machined steel; hollow body 12 is made of accurately machined but more malleable steel; valve body 26 may preferably be made of steel of a hardness HD, measured using the Brinell test, of 145 to 175 kg/mm$^2$; and hollow body 12 may be of a hardness HD of 100 to 125 kg/mm$^2$.

The taper of truncated-cone-shaped surfaces 53 and 56 is selected as a function of the plasticity of the material of valve body 26 and hollow body 12, and must be such as to enable removal of valve body 26. Using the materials indicated above, the taper may be so selected as to form, for surfaces 53 and 56, an angle a at the vertex ranging between 100° and 150°.

Advantageously, portion 59 may have a small relief angle to assist insertion inside seat 21 during assembly, and to assist removal when disassembling valve body 26; and, to ensure rod 14 is guided straightly, the length of portion 59 is 1 to 2 times the length of portion 52.

Metering valve 24 (FIG. 1) is fitted to injector 11 by inserting body 26 of valve 24 inside seat 21 of hollow body 12, and rod 14 inside hole 36; and then screwing ring nut 31 to thread 19 to force truncated-cone-shaped surface 53 of body 26 against truncated-cone-shaped surface 56 of seat 21.

Operation of injector 11 is known and therefore only described briefly.

When the electromagnet is energized, stem 25 of the armature is raised; the fuel pressure in control chamber 38 opens metering valve 24, so that rod 14 is raised to open the nozzle of injector 11; and the fuel in chamber 38 is discharged into the tank via chamber 32 and fitting 33.

When the electromagnet is deenergized, a spring (not shown) lowers stem 25 and pushes ball 48 against conical seat 50 (FIG. 2) to close valve 24; and the fuel pressure inside control chamber 38 now increases rapidly to lower rod 14 and close the nozzle of injector 11.

The advantages, as compared with known devices, of the fastening and sealing device according to the invention will be clear from the foregoing description. In particular, no seal of elastic material is required for sealing valve body 26, which therefore need not be disassembled for periodically replacing the seal.

Clearly, changes may be made to the sealing device as described and illustrated herein without, however, departing from the scope of the accompanying claims. For example, inlet conduit 41 may be located at chamber 38 as opposed to hole 36; and cylindrical portion 59 of valve body 26 may be eliminated.

I claim:

1. A device for fastening and sealing a metering valve (24) in an internal combustion engine fuel injector (11), wherein the injector (11) comprises a hollow body (12) supporting a nozzle, and the metering valve (24) has a valve body (26) housed in a seat (21) of said hollow body (12); said valve body (26) having a flat surface (28) engaged by a ring nut (31) in said hollow body (12); characterized in that said valve body (26) comprises a portion (52) having an outer truncated-cone-shaped surface (53); said seat (21) comprising a portion (54) having an inner truncated-cone-shaped surface (56); said truncated-cone-shaped surfaces (53, 56) having the same taper, and engaging mutually in fluidtight manner by virtue of said ring nut (31).

2. A device as claimed in claim 1, wherein said flat surface is carried by a flange of said valve body (26); characterized in that said valve body (26) is made of steel of a hardness HD, measured using the Brinell test, of 145 to 175 kg/mm$^2$; said hollow body (12) having a hardness HD of 100 to 125 kg/mm$^2$.

3. A device as claimed in claim 2, characterized in that said taper has an angle (a) at the vertex ranging between 100° and 150°.

4. A device as claimed in claim 1, wherein said valve body (26) comprises a guide seat (36) for guiding a control rod (14) of the injector (11), and a control chamber (38) coaxial with said guide seat (36); said control chamber (38) having an inlet conduit (41) for high-pressure fuel to act on said control rod (14), and communicating with a discharge chamber (32) via a discharge conduit (44); and said inlet conduit (41) extending radially with respect to said guide seat (36) at an annular cavity (39) of said valve body (26) for accumulating and distributing said high-pressure fuel; characterized in that said annular cavity (39) is located at said portion (52) of the valve body (26), so as to divide the respective truncated-cone-shaped surface (53) into two regions (57, 58); one of said regions (57, 58) sealing between said annular cavity (39) and said discharge chamber (32), and the other of said regions (57, 58) sealing between said annular cavity (39) and an axial cavity (13) of said hollow body (12).

5. A device as claimed in claim 4, characterized in that said valve body (26) also comprises a further portion (59) having a substantially cylindrical surface coaxial with said guide seat (36).

6. A device as claimed in claim 5, characterized in that the length of said further portion (59) is 1 to 2 times the length of said portion (52) of said valve body (26) having said truncated-cone-shaped surface (53).

* * * * *